US007472871B1

(12) United States Patent
Demontegnac

(10) Patent No.: US 7,472,871 B1
(45) Date of Patent: Jan. 6, 2009

(54) CLAMP-ON BABY BOTTLE HOLDER

(76) Inventor: Lilias B. Demontegnac, 332 SW. Northshore Blvd., Port Saint Lucie, FL (US) 34986

( * ) Notice: Subject to any disclaimer, the term of this patent is extended or adjusted under 35 U.S.C. 154(b) by 0 days.

(21) Appl. No.: 11/846,674

(22) Filed: Aug. 29, 2007

(51) Int. Cl.
*A47D 15/00* (2006.01)

(52) U.S. Cl. ..... 248/104; 248/102; 248/105; 248/106

(58) Field of Classification Search ..... 248/105, 248/106
See application file for complete search history.

(56) References Cited

U.S. PATENT DOCUMENTS 5,135,189 A * 8/1992 Ghazizadeh ..... 248/104
5,192,041 A * 3/1993 Bryant ..... 248/104
6,386,490 B1 * 5/2002 Suh ..... 248/104

* cited by examiner

*Primary Examiner*—Amy J. Sterling

(57) ABSTRACT

A clamp-on baby bottle holder that can be suitably used in a baby car seat, a crib, a stroller, or an infant seat or highchair.

7 Claims, 3 Drawing Sheets

CLAMP-ON BABY BOTTLE HOLDER

FIELD OF THE INVENTION

The present invention generally relates to an infant accessory and more particularly, relates to a clamp-on baby bottle holder that can be used in a car seat, in a stroller, in a crib, or in a highchair.

BACKGROUND OF THE INVENTION

Baby bottles are the most frequently used baby accessory in any family that has babies or young toddlers. In order to feed a baby with a baby bottle, the bottle must be held by the hand of a parent or a caregiver. The full attention of the parent or the caregiver must be given to the baby feeding process and thus, preventing the parent or caregiver to perform any other household activities while the baby is been fed.

It is therefore desirable to provide a device that can hold a baby bottle while a baby is drinking such that the parent or the caregiver can be free to attend to other activities or household chores.

It is an object of the present invention to provide a baby bottle holder that can be used to feed a baby without the full attention of a parent or a caregiver.

It is another object of the present invention to provide a baby bottle holder that can be clamped onto a fixed object.

It is still another object of the present invention to provide a baby bottle holder that can be used in a car seat, in a stroller, in a crib or in a highchair.

It is a further object of the present invention to provide a baby bottle holder that has a flexible arm such that the position of the holder can be easily adjusted.

SUMMARY OF THE INVENTION

In accordance with the present invention, a clamp-on baby bottle holder that can be used in conjunction with a car seat, a stroller, a crib, or a highchair is provided.

The present invention clamp-on baby bottle holder can be constructed by a flexible member that has a top end and a bottom end; a bottle holder that is attached to the top end of the shapeable, a bottle gripper for holding a baby bottle; and a clamping device that is attached to the bottom end of the flexible member, for attaching to a fixed position object.

BRIEF DESCRIPTION OF THE DRAWINGS

The invention will now be described, by way of example, with reference to the accompanying drawings, in which.

DETAILED DESCRIPTION OF THE PREFERRED AND ALTERNATE EMBODIMENT

Figure 1:
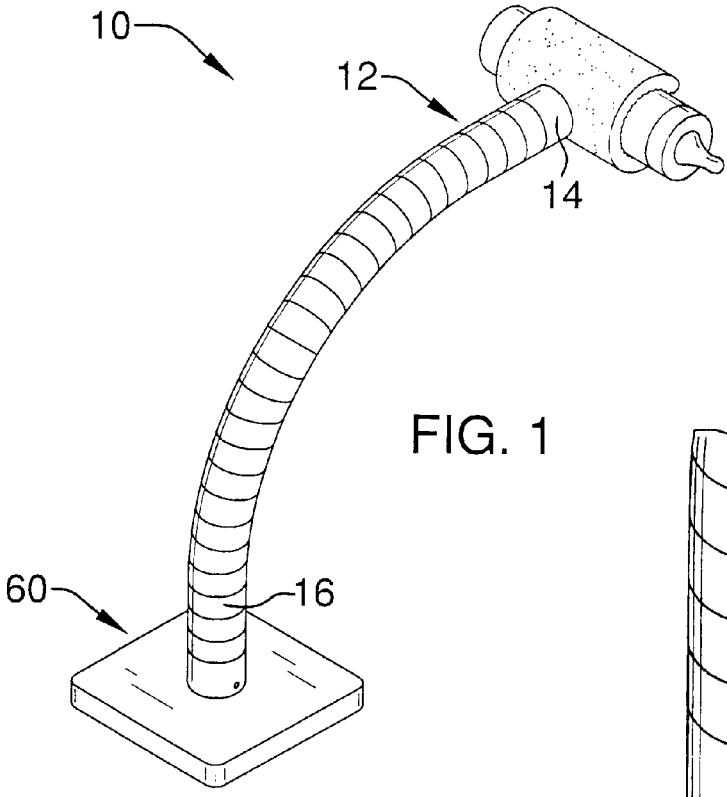
FIG. 1 is a perspective view of the present invention clamp-on baby bottle holder on a detachable base.
Figure 2:
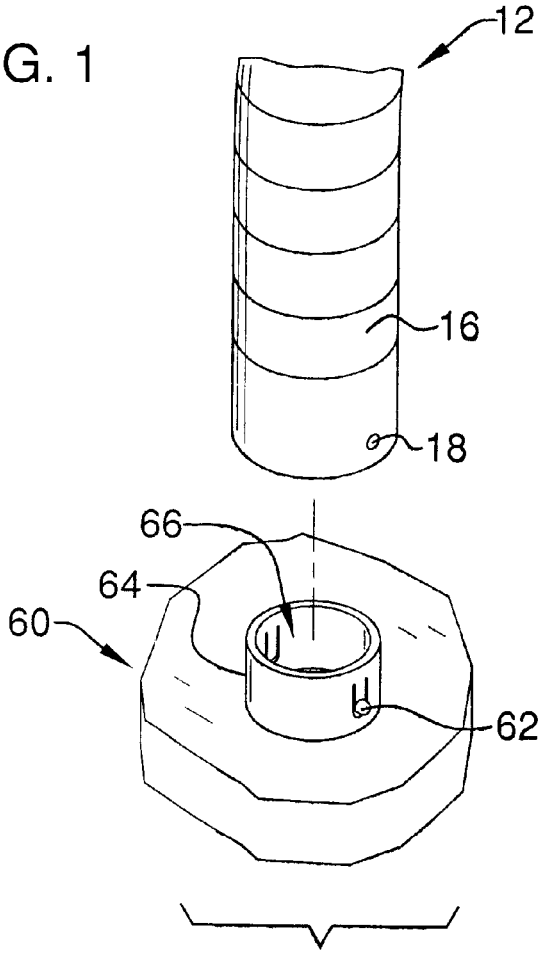
FIG. 2 is a partial perspective view of the flexible arm for the present invention baby bottle holder separated from the base.

The present invention discloses a clip-on baby bottle holder that can be advantageously used in a baby car seat, a stroller, a crib, or an infant seat by clipping a spring clip to a fixed positioned object.

The present invention clip-on baby bottle holder is an accessory that is designed to hold a baby bottle to free a parent or other care giver to simultaneously perform other duties while a baby is drinking. The baby bottle holder features a flexible arm that can be bended and shaped that can be attached to a clamp at one end. The clip can be used to attach to a car seat, a stroller, a crib, or any other furniture such as an infant highchair. The other end, or the top end of the baby bottle holder is a holder that can be sized and shaped to hold a cylindrical shaped baby bottle.

The flexible member of the baby bottle holder is a helically wound hollow tube. The flexible design allows the baby bottle holder to be shaped and positioned to place the bottle in a comfortable drinking position for the baby. As a possible variation to the flexible design of the baby bottle holder, elongated member can also be made of multiple segments connected together by ball joints. The baby bottle can be held in a shock absorber-supported holster such that the bottle cannot be forced into the baby's mouth. The present invention baby bottle holder can be advantageously designed to attach to a car seat/carrier, a stroller, or any other baby or infant seat. The bottle can be held in drinking position for the baby, allowing the baby to drink independently without a parent having to hold the bottle.

The present invention baby bottle holder fulfills the need for a more convenient way to feed a baby that would leave the parent free to attend to other duties or actives. The appealing features of the present invention baby bottle holder are its convenience, low cost, and ease of use. The baby feeding accessory can save time for a busy parent by enabling him or her to simultaneously perform other duties or actives while a child is feeding. Busy parents of more that one child can give the baby a bottle as they fed or otherwise attend to other siblings. For instance, while keeping an eye on the baby's feedings, the parent can also straighten a room, do the dishes, or perform any other countless baby tasks while the infant is being fed. The present invention clamp-on baby bottle holder therefore allows a parent to perform multi-tasks. Instead of the adult caregiver trying to rush a feeding because of lack of time, the baby bottle holder allows a baby to enjoy a bottle at his or her leisure, providing a greater level of satisfaction to both the baby and the parent.

The present invention clip-on baby bottle holder is ideal for use in the car. It would hold the baby's bottle while the parent continue to drive in a safe manner. Parents would not have to stop the car to feed the baby or reach back dangerously and struggle to hold the bottle or find a dropped bottle.

The present invention clip-on baby bottle holder can be used not only by parents of young children or infant, it can also be used by operators of daycare facilities.

Referring initially to FIG. 1, wherein a present invention clamp-on baby bottle holder 10 is shown. The baby bottle holder 10 is constructed by a flexible member 12 that has a top end 14 and a bottom end 16. The flexible elongated member 12 may be suitable supply in a spiral-wound metal tube which can be easily shaped and then retaining its shape. The flexible elongated member is connected to a fixed position base 60 at the bottom end 16. The connection is made by engaging through hole 18 with a spring-loaded engaging button 62 on a mounting tube 64 that is fixed to the base 60, when the bottom end 16 is inserted into the cavity 60 of the mounting tube 64.

Figure 4:
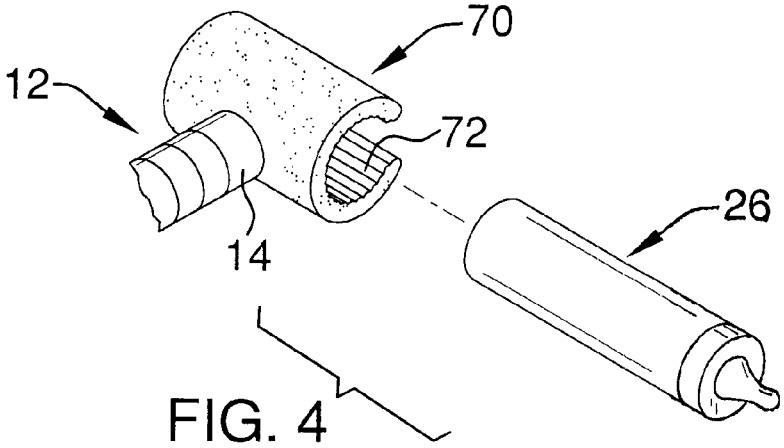
FIG. 4 is a partial, perspective view of the bottle gripper.

At the top end 14 of the shapeable, elongated member 12, shown in Figures land 3, is provided a bottle gripper 70 which is a C-shaped holder fixedly connected to the top end 14. It is seen that C-shaped holder or the bottle gripper 70 is formed with serrated teeth 72 preferably formed of a pliable material for improved gripping power. A suitable material is foam or rubber. A cylindrical baby bottle 26, can be inserted into the bottle gripper 70. This is shown in FIG. 4.

At the top end 14 of the flexible member 12, a bottle gripper 70 is utilized for holding the baby bottle 26. This is shown in FIG. 4. The bottle gripper 70 may be suitably formed of a plastic material and connected to the upper end 14 of the flexible member 12.

Figure 3:
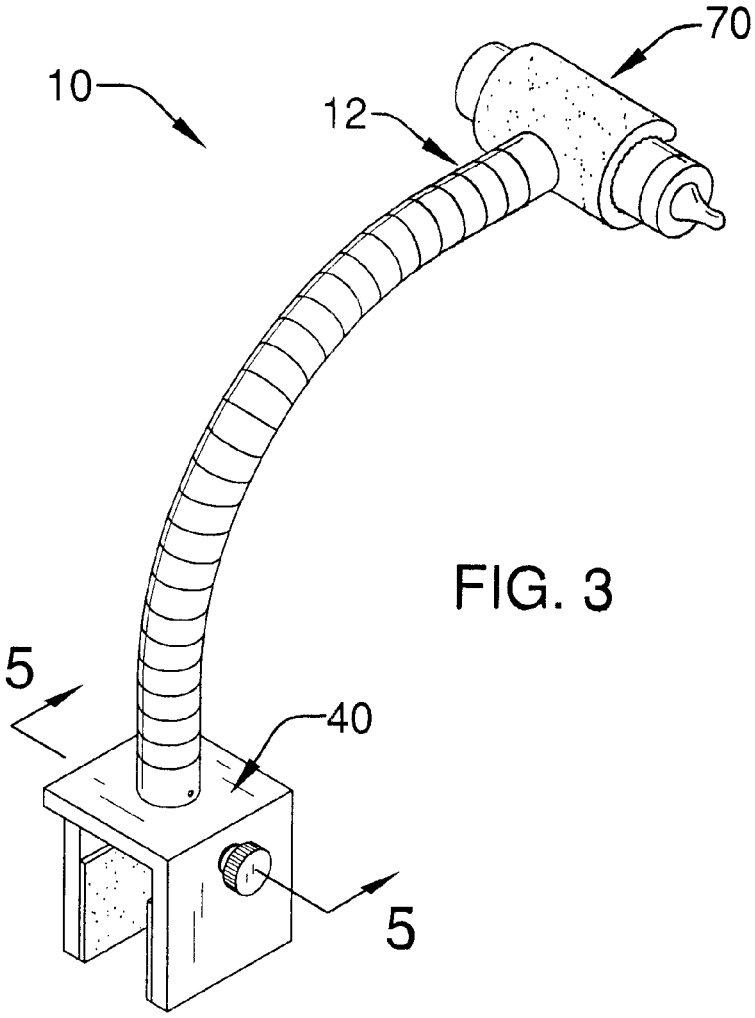
FIG. 3 is a perspective view of the present invention clamp-on baby bottle holder complete with a clamp.

At the bottom end 16 of the metal tube 12, as shown in FIG. 3, is connect a clamp 40 that is equipped with a tightening knob 42 and two cushion members 44, 46. The clamp 40 can be used to fix the present invention baby bottle holder 10 to any fixed position object such as a baby car seat, a crib, a baby carrier or stroller, or an infant seat or highchair.

Figure 5:
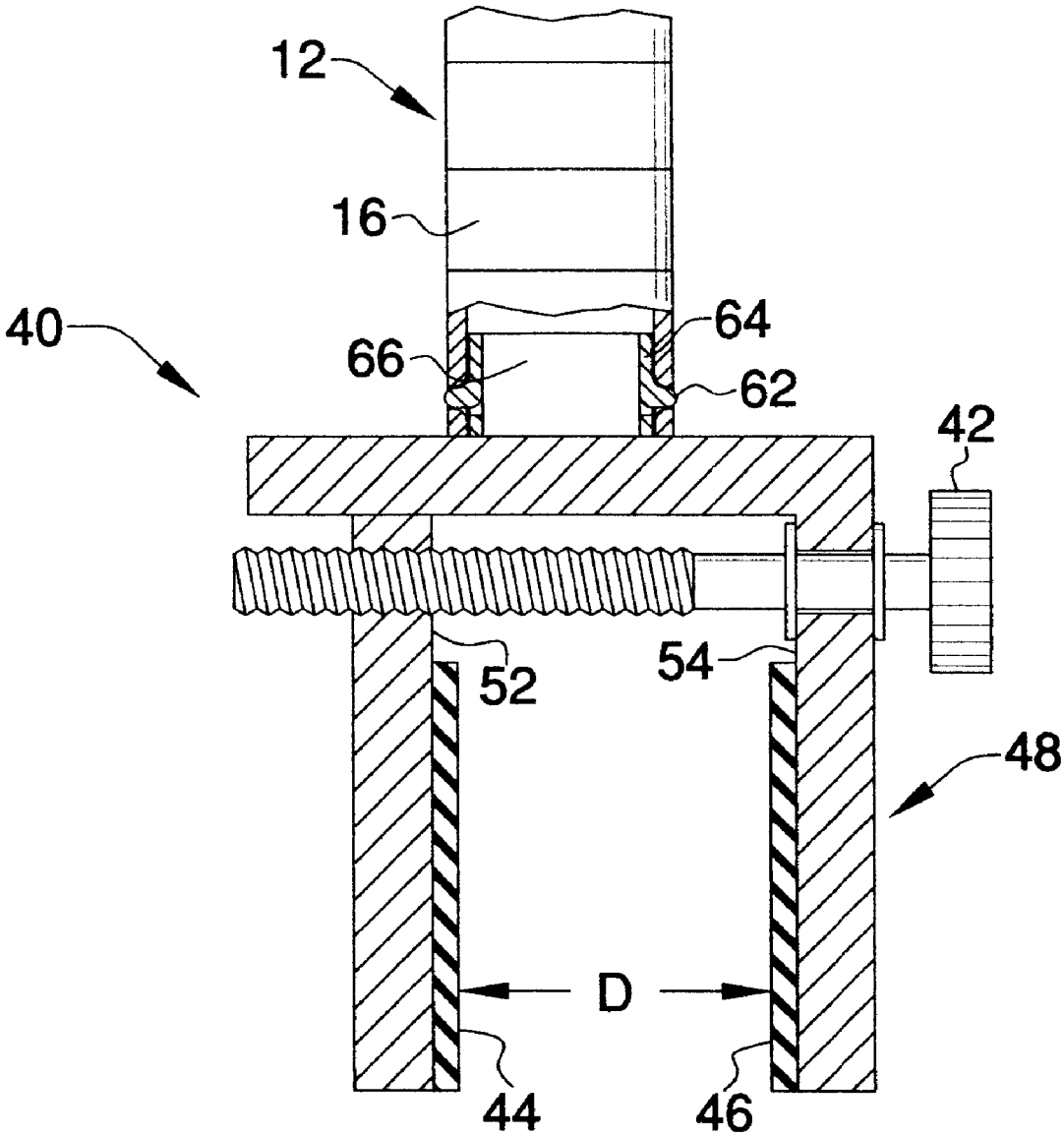
FIG. 5 is a cross-sectional view of a clamp for the present invention clamp-on baby bottle holder.

FIG. 5 is a cross-sectional view of the clamp 40, illustrating a U-shaped clamp body 48 with cushion members 44,46 on two inside surfaces 52,54 to provide a firm grip. The flexible member 12 that is a helically wound hollow tube can be formed of a suitable metallic material that would sustain and hold a shape and still be durable after numerous shaping and bending without breakage or cracking. The distance "d" between the two cushion members 44,46 can be suitably adjusted by turning the tightening knob 42 either clockwise or counter-clockwise.

The present invention clamp-on baby bottle holder has therefore been amply described in the above descriptions, and in the preferred embodiment shown in FIGS. 1-5.

While the preferred embodiments of the invention have been described above, it will be recognized and understood that various modifications can be made in the invention and the appended claims are intended to cover all such modifications which may fall within the spirit and scope of the invention.

What is claimed is:

1. A clamp-on baby bottle holder comprising:

a flexible, elongated member having a top end and a bottom end;

a bottle gripper attached to said top end of the flexible, elongated member for holding a baby bottle; said bottle gripper is a C-shaped holder with serrated teeth on an inside surface; the bottle gripper being formed of pliable material and a U-shaped adjustable clamping device attached to said bottom end of the flexible, elongated member for attaching to a fixed-position object with a spring loaded mounting button located on a base of the elongated member for releasably attaching and detaching the elongated member to the clamping device.

2. The clamp-on baby bottle holder according to claim 1, wherein said flexible, elongated member is formed of a helically wound hollow tube.

3. The clamp-on baby bottle holder according to claim 1, wherein said flexible, elongated member is formed of a helically wound hollow tube covered with a soft plastic layer.

4. The clamp-on baby bottle holder according to claim 1, wherein said flexible, elongated member is formed of a spiral-wound metal tube.

5. The clip on baby bottle holder according to claim 1, wherein said bottle gripper is formed of a plastic material.

6. The clip on baby bottle holder according to claim 1, wherein said clamping device is a U-shaped adjustable clamp.

7. The clip on baby bottle holder according to claim 1, wherein said fixed-position object is selected from the group consisting of a baby car seat, a crib, a stroller, an infant seat, and a highchair.

* * * * *